US006525008B2

(12) United States Patent
Hartmann et al.

(10) Patent No.: US 6,525,008 B2
(45) Date of Patent: Feb. 25, 2003

(54) CLEANING COMPOSITION FOR PRINTING PRESSES

(75) Inventors: Thomas Hartmann, Neusäss (DE); Hans-Christoph Beltle, Gersthofen (DE); Andrea Fuchs, Augsburg (DE); Roland Dietrich, Stadtbergen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/746,134

(22) Filed: Dec. 21, 2000

(65) Prior Publication Data

US 2001/0008877 A1 Jul. 19, 2001

(30) Foreign Application Priority Data

Dec. 24, 1999 (DE) ..... 199 63 124

(51) Int. Cl.[7] ..... C11D 1/29; C11D 1/83; C11D 3/14; C11D 3/43

(52) U.S. Cl. ..... 510/170; 510/171; 510/172; 510/173; 510/174; 510/395; 510/397; 510/432

(58) Field of Search ..... 510/170–174, 510/395, 397, 432

(56) References Cited

U.S. PATENT DOCUMENTS

| | | | | |
|---|---|---|---|---|
| 4,797,231 A | * | 1/1989 | Schumann et al. | 252/547 |
| 5,203,926 A | | 4/1993 | Bondurant | 134/42 |
| 5,298,181 A | * | 3/1994 | Choy et al. | 252/95 |
| 5,382,298 A | | 1/1995 | Bondurant | 134/42 |
| 5,460,742 A | * | 10/1995 | Cavanagh et al. | 252/144 |
| 5,601,022 A | | 2/1997 | Daver et al. | 101/467 |

FOREIGN PATENT DOCUMENTS

| | | |
|---|---|---|
| CA | 21 54 012 | 1/1996 |
| EP | 570 879 | 11/1993 |
| EP | 693 371 | 1/1996 |
| EP | 698 488 | 2/1996 |
| FR | 2 713 110 | 6/1995 |
| WO | WO 92/03528 | 3/1992 |

* cited by examiner

*Primary Examiner*—Yogendra N. Gupta
*Assistant Examiner*—Brian P. Mruk
(74) *Attorney, Agent, or Firm*—Cohen, Pontani, Lieberman & Pavane

(57) ABSTRACT

A cleaning medium for use in cleaning printing forms includes either an acid solution having a pH of from 1 to 4 or a basic solution having a pH of from 10 to 14. A dispersible abrasive agent in a concentration of from 1 to 15 grams per 100 grams of the cleaning composition, a surfactant in a concentration of from 1 to 50 grams per 100 grams of the cleaning composition, an organic solvent in a concentration of from 10 to 50 grams per 100 grams of the cleaning composition, and additional water if needed are added to the acid or basic solution to form the cleaning medium. A cleaning medium in concentrate form is also provided.

20 Claims, No Drawings

CLEANING COMPOSITION FOR PRINTING PRESSES

BACKGROUND OF THE INVENTION

1. Field of the Invention

The invention relates to a generic cleaning medium, i. e., a cleaning composition, for cleaning the components in a printing press, in particular for the cleaning or removal of reusable, imaged lithographic printing forms which have been through one printing process. More particularly, the present invention relates to a cleaning medium for printing forms, which are imaged by means of a laser induced thermal transfer ribbon technique. The invention also relates to concentrates of the cleaning medium and its use in containers for shipping and for application. Furthermore, the present invention also relates to an erasure method for using the cleaning medium of the present invention.

2. Description of the Related Art

European Reference EP-B-0 570 879 discloses a method and a device for repeated erasure of the ink layer from the surface of an imaged printing form as used in offset printing. A solvent free jet of water under pressure is directed at an angle onto the imaged surface by means of an erasing device to clean the imaged surface. The medium, which essentially comprises solvent free water under pressure, can contain abrasive additives such as grit and the like or chemical additives having wax dissolving properties, to increase the removal capacity of the jet.

European Reference EP-B-0 693 371 discloses an erasable printing form together with a method and a device for erasing and regenerating the printing form. The reference teaches that after the printing process the printing ink residue and the imaged layer are first removed by a cleaning medium, for example, wiped off. The cleaning medium is a solvent or a solvent agent mixture, which does not contain solid components. In order to remove the last of the residue of the imaged layer on the printing form, however small this is, the surface is subsequently rubbed mechanically. A cleaning medium containing a polishing agent is used, for example an ordinary plate cleaner, which is generally known to be used in for manual cleaning of printing forms. This plate cleaning agent is then removed afterwards, for example, with water.

The mechanical interaction between the cleaning media and the printing form is by means of a cleaning device, which is provided with a cleaning cloth or non-woven cleaning fabric, and which is pressed from a supply roller (clean roll) over another roller against the printing form and then rolled up onto a winding roller (dirty roll).

European Reference EP-B-0 698 488 discloses a method and device for the manufacture of a printing form, whereby a synthetic resin composition is image transferred from a thermal transfer foil to a rotating printing form cylinder by means of a laser. The material transferred by the thermal transfer foil forms the ink supply layer of the printing form.

In pending German Patent Application No. 199 37478.3, a thermal transfer foil or a thermal transfer ribbon for imaging of lithographic printing forms is disclosed, including a substrate layer to which a donor layer is applied. The substrate layer in this case is composed of at least one polymer substance, preferably PET, which has at least the following properties: mechanical stability at a temperature of 150° C. and transmission greater than 70% for a light band of from 700 to 1600 nm. The donor layer includes at least the following components: a substance which can transform the radiation energy of an impacting laser light into heat energy, a polymer which includes acid groups and/or their substitute amide groups (where appropriate) and if necessary, a wetting aid. Preferably the substance to transform radiation energy to heat energy is carbon black. Preferably, the acid groups of the polymer include a styrene/(meth) acrylic acid/(meth)acrylate copolymer and/or their substitute amide groups, where appropriate. Preferably, the working agent is methylethylketone (MEK).

Presently, commercially available plate cleaners or other media for cleaning printing forms or other media for cleaning printing forms for the lithographic printing process, but also for cleaning rubber sheets and other movable soiled parts of the printing machine, either fail to meet, or only partially meet the following essential requirements:

(a) sufficient viscosity;

(b) work safety and hygiene;

(c) non-destructive to printing form;

(d) non-abrasive to printing form;

(e) absorbent cleaning cloth;

(f) complete emulsification of cleanser agent; and (g) non-deteriorative of lithography printing surfaces.

Deficiencies noted in prior art cleaning compositions regarding the above mentioned requirements include:

(a) Unsuitable viscosity or unsuitable rheologic behavior, e.g. thixotrophy, prevents application of cleaning media to the printing form or to a cleaning cloth to be used for cleaning, without causing difficulties hydraulically and with respect to fluid mechanics.

(b) The known formulations did not conform to all work hygiene and technical safety requirements, in particular in connection with closed printing machines, in which an erasure process is to be performed (e.g., problems include aerosol formation dripping and the like);

(c) Since the erasure process is to be performed inside the printing machine, i.e., without removing the printing form, the known formulations are often chemically too aggressive. For example, solvents have a detrimental effect on synthetic material, rubber and other vulcanized rubber parts. Other aggressive and corrosive influences have also been noted.

(d) The abrasive effect on the printing form exceeds the acceptable tolerance in the area of working pressure of the cleaning device and leads to damage (e.g., scratches, abrasive agent deposits, etc.) on the printing form.

(e) The wetting nature of the cleaning cloth, both during application of the cleaning medium to the printing form and also in the removal of the loosened "dirt" (ink residue, imaging material, wetting agent constituents, paper dust, etc.) must be such that the fluid constituents can penetrate the cleaning cloth. This is so as to avoid, for example, the cleaning medium dripping during its application. When removing the loosened "dirt", for example, this is then prevented from reforming on the printing form through the non-woven web.

(f) The cleaner is not completely emulsive in water, such that sufficient transport and rinsing properties are not maintained and ready transport of unused cleaner is not possible.

(g) Certain cleaning media irreversibly deteriorate the wetting properties of the printing surface or alter the printing surface in an unfavorable manner (i.e., background hue) in lithography applications.

SUMMARY OF THE INVENTION

The object of the present invention is to overcome the limitations of the prior art by providing a simple cleaning composition that avoids the use of additional stabilizing agents which are not part of the cleaning process, and which can cause possible interference with the subsequent flatbed printing. The cleaning medium of the present invention includes:

(a) a substance which produces a pH of from 1 to 4 in aqueous solution, or a substance which produces a pH of from 10 to 14 in aqueous solution;

(b) dispersible abrasive agents;

(c) surfactants and if required complexing agents;

(d) an organic solvent;

(e) water and if required, further technically necessary additives.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Substances producing a pH value of from 1 to 4 or from 10 to 14

To prepare the aqueous solution of the cleaning medium of the present invention having a pH of from 1 to 4, the usual organic or inorganic acids can be used. For the sake of economy, inorganic acids are preferred. The inorganic acids must not have a detrimental chemical effect on the printing form cylinder. Oxo-acids of the fifth and sixth main group of the periodic system of the elements and halogen hydrogen acids are suitable acids. Phosphoric acid is particularly advantageous. Phosphoric acid is recognized as relatively safe physiologically, is relatively inexpensive, keeps well and does not have detrimental effects on the surface of the printing form. It is assumed that the phosphoric acid on the surface of the printing form forms phosphate and hydroxy phosphate of relatively low solubility, which supports the hydrophilic process by the formation of hydrophilic centers. In other words, phosphoric acid has a phosphatizing effect on steel surfaces in the pH range of from 2.8 to 3.6.

Surface phosphates are formed, such as hopeite ($Fe^{3+}$) and in the presence of Zn, phosphophyllit ($Zn_2Fe^{2+}(PO_4)_2*4H_2O$). After the use of phosphoric acid cleaners, contact angle measurement (according to Owens, Wendt and Rabel) of Ni and Fe based printing forms, show an increase of the surface tension by about 30 mN/m and an increase in the polar part by 30%. The dipole/dipole interactions on the substrate surface lead to better wetting through "dirt" coated substrate areas and to the idea generally accepted in the paint and varnish industry, that $FePO_4*PO_4$ layers significantly improve the adhesion of polymer laminating. In addition, the solvent power of phosphoric acid printing ink in conjunction with the other previously named constituents is sufficiently high. The previously named acids are used as a solution in a concentration ranging from 10% to almost 100%, in particular from 30% to 90%. For phosphoric acid, the usual commercial concentration supplied, which is between 80% and 90%, usually 85%, is sufficient. For 100 g cleaning medium, 2 g to 30 g of the above named acids are used, preferably 4 g to 15 g, in particular 5 g to 10 g.

In the case of an alkaline medium, any substances producing a pH value≧10 can be used. Suitable are all completely soluble hydroxides of the alkali metals, alkaline earth metals and ammonia, ammonium and phosphonium compounds. Especially preferred are alkali metal hydroxides and carbonates. Preferred are again sodium hydroxide and potassium hydroxide, whereby sodium hydroxide is especially preferred. The amount of alkaline compound used lies in the range of from 0.3 to 10 g, in particular 0.5 to 5 g, especially preferred 0.7 to 2 g, most preferably 0.8 to 1.5 g, per 100 g formulation. When converted to the pH value, the amount of an aqueous solution used, is a concentration of 0.5 Mo1/1, at 30 to 60 g per 100 g formulation, in particular 40 to 50 g, especially preferred is a concentration of from 44 to 46 g, per 100 g formulation. In the case of sodium hydroxide, an especially preferred amount is from 44 to 46 g/100 g of a 0.5 Mol/1 NaOH solution.

The Abrasive Agent

The abrasive agent must not have any detrimental effect on the printing form during its application to the printing form, to the cleaning cloth, or during mechanical treatment. In particular, the structure and hardness of the abrasive agent must avoid damaging the printing form while at the same time effectively performing the removal process, mainly removing printing ink residue remaining on the printing form, in particular crusted ink residue. The imaging resin composition must be effectively supported. Furthermore, it is necessary for the abrasion particles of the abrasive agent to remain in suspension for as long as possible. For this reason for example, known abrasive agents such as α-aluminum oxide (calcination temperature of approximately 1200° C.), are only conditionally suitable, as they do not have surface charge and are therefore difficult to disperse and form a colloid solution only with difficulty. Apart from this, as a rule the α-aluminum oxides are too hard and would therefore also have too powerful an abrasive effect on the printing form. The two above named requirements essentially give rise to two parameters, which must be observed when selecting the abrasive agent. First, the abrasive effect, which is dependent both on hardness of the abrasive particles and on the size of the particles (abrasive granule figure) must not be too strong. Second, the zeta potential or the particles in aqueous solution, which is responsible for the stabilization of the suspension must be sufficient. With respect to the abrasive particle size, it has been determined that an average size of <1 μm, preferably <0.1 μm, and especially preferred <50 μm, more especially preferred in the range of from 5 to 35 nm, in particular from 10 to 15 nm, is especially suitable. Regarding the charge on the abrasive particles, the zeta potential should be at least 10 mV, more preferred 20 mV, most preferred 35 mV. The range of zeta potentials in the case of $Al_2O_3$—C should be from 0 to 40 mV at a pH of <9. In the case of Aerosil OX50 (Degussa-Hüls), for example, the range of zeta potentials should be from −70 mV to +20 mV at a pH of <9. Preferably, the abrasive agent consists of metal oxides, depending on the nature of the respective metal oxide a zeta potential of more than +10 mV or of more than −10 mV.

The abrasive particles are preferably made from metal oxides or metalloid oxides having the general formulation $M^{III}O$, $M^{III}{}_2O_3$, $M^{IV}O_2$, $M^{II,III}{}_3O_4$, wherein $M^{II}$ is selected from metals of the II group of the periodic table, $M^{III}$ is selected from the metals of the III group of the periodic table, transitional metals, and lanthanide, and $M^{IV}$ is selected from the metals or metal oxides of the IV group of the periodic table. Aluminum oxide, zirconium oxide, silicium dioxide, zinc oxide and iron oxide are preferred.

The effect on Ni and Fe based substrates of application of the abrasive agents is a homogenizing (symmetrical Abott graph) of the Rz values. These effects can be defined via a perthometer (Fokodyn laser scanner) or white light interferometer. In addition, suitable abrasive agents reveal their contribution to the increase in the polar percentage of the surface tension after application. It has been ascertained that of the abrasive particles which come under consideration, δ-aluminum oxide, e.g. $Al_2O_3$—C by Degussa is especially suitable.

$Al_2O_3$—C (Degussa) i.e., CAS No. 1394-28-1 is made by high temperature hydrolysis of $AlCl_3$. The primary particles which arise in this way are without exception cubic with rounded comers (REM) wherein the average size of the primary particles is 13 mn. BET tests (DIN 66131) show no mesopores in hysteresis examinations and thus the particles have no internal structure (as opposed to γ-$Al_2O_3$, which is used in chromatography due to its internal structure). The pH value of a 4% weight aqueous dispersion after removal of hydrochloric acid impurities is greater than 7.5 (DIN ISO 787/IX) and indicates that the surface OH groups react weakly alkaline. The isoelectric point at pH=9 is therefore understandable. If the pH value now decreases below 9, the zeta potential increases to +40 mV. At pH values greater than 9, a negative surface charge prevails in (pH=10, −20 mV). The specific density of $Al_2O_3$—C is approximately 3.2 g/ml and the dielectric constant is 5.

The abrasive agent is used in an amount of from 1 to 15 g, preferably from 2 to 20 g, more preferred from 2.5 to 8, and in most preferably from 3 to 6 g per 100 g formulation.

The surfactant

The surfactant, among other things, brings about the micelle formation of the oleophilic ink residue, so that it is suspended in water and can be removed from the surface. Furthermore, the surfactants acts as an emulsifier between the aqueous, acidic or alkaline phase and the hydrocarbon phase. It is assumed that the emulsion drops loosen the printing ink and suspend it in the aqueous phase and support the surfactant molecules in stabilizing the emulsion while also stabilizing the vesicle charged with printing ink. In general, any surfactant is suitable for this process. Among the known ionogenic surfactants, such as cationic, anionic and ampholytic, the cationic and anionic surfactants are the most suitable. It has been determined that anionic surfactants, which contain a polyoxyalkyl chain are especially well suited. A preferred of this compound is composed of a polyoxyalkyl residue, linked with an aromatic nucleus, which via an alkyl bridge bears an acidic group, such as a sulfonic, sulfate, carboxyl or phosphate group. A surfactant with a polyoxyethylene chain with 2 to 12 ethylene oxide units, 2 to 16 methoxide units or 2 to 7 propoxide units, linked to an aryl group, which is substituted with a sulfate or sulfonic acid group linked by an alkyl group is preferred. Especially preferred is the surfactant Triton X-200 which essentially retains its technical properties independent of pH value. For example, it does not precipitate if there is a change in pH nor lose an essential part of its surfactant nature. Furthermore, Triton X-200 exhibits excellent antistatic properties as known in the field of AgX photography. This is probably due to the presence of $SO_3Na$ groups and the presence of the $(CH_2CH_2O)$ chain.

Pure non-ionogenic surfactants are only conditionally suitable for the above purpose, as for example, they tend to be adsorbed by metal surfaces, such as the surface of a printing form. For this reason, non-ionogenic surfactants should either be avoided completely or used solely in a mixture with the above named ionogenic surfactants. Mixing ratios of 1:10 to 10:1 are satisfactory.

In the case of an acid formulation the concentration of the surfactant is in the range of from 0.1 to 50 g, in particular 1 g to 50 g per 100 g formulation, preferably from 2 g to 10 g per 100 g formulation, especially preferred from 3 g to 8 g per 100 g formulation. In the case of an alkaline formulation, the concentration of the surfactant is in the range of from 0.1 to 50 g, in particular from 1 to 20 g per 100 g formulation, more preferred from 8 to 15 g per 100 g formulation, most preferred from 9 to 12 g per 100 g formulation.

A preferred class of surfactants are alkylarylpolyglycolethersulfates, e.g., sodium alkylarylpolyether sulfonate CAS No. 2917-94-4, (available from Union Carbide Co., Benelux N.V.) having a CMC (critical micelle concentration, at 100 weight %) of about 230 ppm.

Structure:

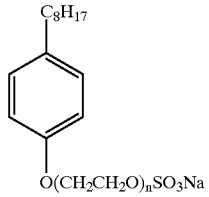

wherein n is preferably from about 2 to 7.

Ross-Miles foam height (25°)

| Concentration (weight %) | Height T = 0 min. [mm] | Height t = 5 mm [mm] |
|---|---|---|
| 1.0 | 205 | 80 |
| 0.1 | 155 | 75 |
| 0.01 | 25 | 15 |

The complexing agent

The cleaning medium of the present invention may, if necessary, contain a complexing agent, whereby the complexing agent is selected from EDTA (i.e., ethylenediaminetetraacetic acid, disodium salt, dihydrate, ethylenedinitrilotetraacetic acid, disodium salt, dihydrate), EGTA (i.e., ethylene glycol-(β-aminoethylether)N,N,N',N'-tetraacetic acid), AMP (aminomethylphosphonate), HEDP (hydroxyethylidine-1,1-diphosphonate), triethanolamine, organic acids (such as malic acid, succinic acid, citric acid, glutaric acid, adipic acid and/or oxalic acid), and mixtures thereof.

The solvent

The solvent for use in the cleaning medium can be any of the usual solvents used in cleaning printing forms. In particular, the solvent should have sufficient solvent power, but should also conform to work hygiene and technical safety conditions in and around the printing machine. In order to be able to take up the ink residue and other residual material arising from the erasure process which are not soluble in water, the solvent should preferably not be soluble but emulsive with the carrier substance of the formulation, i.e., water.

Examples of solvents, which are suitable include aromatic hydrocarbons, aliphatic hydrocarbons both unbranched and branched (isohydrocarbons), esters and ketones. Also, organic solvents, substituted with hetero atoms in or on the chain are suitable. From this class of solvents the aliphatic solvents have proved to be especially suitable for several reasons. Aromatic solvents, such as toluene, mesitylene, cumene etc., although they often show very good results with respect to their solvent power are the only solvents that are not preferred because of their tendency to attack parts in the device which are made of synthetic material or rubber. In addition, they are relatively toxic. This is also true of halogenated hydrocarbons, which do not readily degrade, and are therefore questionable in terms of environmental protection. Among the aliphatic solvents, the isoparaffin solvents are especially well suited. Specifically, isoparaffin solvents of the danger classification A Ill, or posing a low fire hazard, in particular isoparaffin solvents having a flash point of >60° C. are preferred. Among the esters, fatty acid esters, for example, derived from vegetable oils but also from animal oils such as tallow oil, have been proven particular suitable. The fatty acid esters of a vegetable nature are prepared e.g. from coconut oil, palm kernel oils, soya bean oil, sunflower oil, linseed oil or coiza oil, preferably from coconut or palm kernel oils, by a hydrolyzing cleaving and subsequent esterfication and optional transesterfication with monofunctional alcohols (selected from those having from 1 to 24 carbon atoms, preferably 1 to 18, more preferred 1 to 14 alcohols and mixtures thereof). In the case of a transesterfication, preferred alcohols are selected from those having from 2 to 24 carbon atoms, preferably 2 to 18, more preferred 2 to 14, in particular 2 to 10 alcohols and mixtures thereof. Preferred fatty acid esters have an iodine number according to Kaufmann (Deutsche Gesellschaft für Fettforschung DGF C-V 11b) and according to Wijs (ISO 3961) of <100, preferably from 10 to 60. The amount of methyl esters should be as low as possible in order to avoid too high a swelling of the rubber sheet. Preferably, the alcohol part of the esters has from 2 to 24 carbon atoms, in particular from 2 to 18 or 2 to 10 carbon atoms. As the fatty acid, esters of the alcohols ethanol, isopropanol, n-propanol, butanol and ethylhexylalcohol are preferred. These esters may also be present as a mixture. After the hydrolyzing cleaving of fat, the corresponding fatty acids are in mixture and they have, for example, from 6 to 24, preferably from 8 to 18 carbon atoms. Myristic and/or lauric acids are the major components of coconut oil and palm kernel oil. Commercial products of fatty acid esters include the products of the series Endenor® (from Henkel) and Priolube® (from Unichema).

For cleaning a rubber sheet, the fatty acid esters may be used in a mixture with hydrocarbons of parafinic and/or naphthenic nature as e.g. discussed in the foregoing description, the mixture having a weight ratio of from 1:10 to 10:1, preferably from 1:3 to 3:1, more preferred from 1.5:1 to 1:1.5, generally by 1:1.

Important requirements demanded of the ink solvent include redox stability, solvent speed and solvent power (as the measure of the minimum amount of solvent required for the same amount of ink without external effect). The solvent power for ink is determined by the quotient of ink amount and amount of solvent used. Among the particularly suitable parafinic (low aromatic) hydrocarbons, the saturated cyclic (e.g. decahydronaphthalene) and branched acyclic hydrocarbons exhibit the highest ink solvent power with conventional heatset ink in a sedimentation test for 24 hours. Among the preferred isoparaffin hydrocarbons, Isopar L®, a product of the Exxon company, CAS No. 90622-58-59, shows the most favorable ratio. Isopar L® is a mixture of an isoparaffin fraction with a boiling point >189° C., presumably a fraction from $C_{11}$ to $C_{14}$. The flash point of Isopar L is 64° C. The solvent is used in an amount of from 10 to 50 g, preferably from 20 to 40 g, in particular from 25 to 35 g per 100 g formulation.

Further admixtures

The main component of the cleaning medium according to the present invention is water. Water has the advantage that it is practically unlimited in its availability and is generally recognized as safe both physiologically and with respect to the environment. Furthermore, an aqueous milieu supports the level of hydrophilization required to be able to reuse the printing form, i.e., as well as the cleaning effect. The cleaning medium shall preferably also hydrophilize the printing form. There is therefore no need in this case for an additional hydrophilizing agent.

Further substances, which can be added to the formulation are, for example, preservatives, e.g., of a biocide nature, which can be contained in a standard solution of from 1 to 3 weight %, in the event the medium itself is not already sufficiently biocidal. Under specific circumstances, corrosion protection agents, such as molybdat salts, orthophosphates, benzotriazole, tolyltriazole, triethanol amine phosphate and the like can be used.

The properties of the cleaning medium

Viscosity

The viscosity of the formulation ready for use is in the range of from 1 to 500 $mPas^{-1}$. The viscosity is preferably in the range of from 1 to 40 $mPas^{1}$, preferred in the range from 2 to 30 $mPas^{-1}$. The rheologic behavior is preferably designed in such a way that a jet type application system can be operated with it. Too high a viscosity and inappropriate behavior during spraying can therefore be avoided. [Rotating rheometer (Paar Physica, MCR 300); cone/plate 1°; shear rate $50s^{-1}$]. The ready to use formulation does not contain any readily oxidizing components. It does not contain any components, which could lead to autocondensation.

Structure and stability of the cleaning medium

As can be seen, for an especially preferred embodiment of the invention, no further admixtures are included beyond those needed for the cleaning process. An especially preferred formulation of the cleaning medium in accordance with the invention is therefore limited to the essential components. For example, no additional emulsifiers or rheology aids are required or included in the medium of the present invention.

Many of the known cleaning media tend to separate and form two or even more layers. The cleaning media according to the present invention are stable for at least one hour, preferably 24 hours, especially preferred for at least 48 hours. Stable means that there is no occurrence of a visible phase separation. If stored for a long time however, the formulations according to the present invention should in this case be stirred before use i.e. to bring them into the stable emulsion and suspension condition. This is done by the usual means.

Concentrates

The present invention provides concentrates of the above illustrated cleaning media. The term "concentrate" means a combination of the components a) to e) which in particular have a low water content. Preferably, the components being free of water or having a low water content are stored in a container which is capable of receiving a certain amount of the concentrated cleaning medium. Preferably, this amount should be sufficient for operating from the beginning of the use of the cleaning cloth up to the necessary change of the unusable cloth. The container having the concentrate may be provided with a controllable metering device. The concentrate may be ejected dropwise. The dropwise metering may be performed e.g., by a DOD system (drop on demand) based on a piezoelectric ejecting device (ejector).

The drop wise application of the concentrated cleaning medium allows a uniform application. Furthermore, storage of the concentrates in replaceable containers (e.g., in a cartridge) may be advantageous as a long lasting influence of water on the effective components of the concentrate can be avoided. In this way, the storage time may be prolonged. Removing aggressive components (i.e., component a) from the supplying manifold for the cleaning medium also decreases corrosion of the manifold's parts.

The concentrates may be considered intermediate products of the cleaning media according to the invention. They essentially consist of waterfree or reduced water components a) to d) (as well as conventional additives). Component e), namely water, is, for example, led by a supplying manifold to the cartridge containing the concentrate and is mixed in an apparatus in advance of an application to the cleaning cloth or to the printing cylinder, respectively. However, the concentrate and the water may be applied separately. The composition of the concentrates is not limited to the one described above. Further combinations which are possible include components a), b) and c) as a concentrate and d) and e) as the diluting agent; components b), c) and d) as a concentrate and a) and e) as the diluting agent; components a) and b) as a concentrate in an emulsion of c) to e) as the diluting agent, or components a), b) and d) as a concentrate and c) and e) as a diluting agent. Each of the foregoing cases may optionally result in different forms of application and handling which should be considered depending upon which combination is used. The viscosity of the concentrate should preferably be <100 cP, more preferably <35 cP.

The Erasure Method

The aim of the erasure method is to obtain a completely cleaned printing form. Substances which have already been loosened or removed must be prevented from being re-deposited. In general, the erasure process is carried out while rotating the printing form several times.

If the printing form was imaged with a synthetic material which is soluble in an alkaline solution, (i.e., in the case of a printing form imaged with a thermal transfer ribbon, whereby the synthetic material used for imaging is soluble in an alkaline solution) then as the first step the acid cleaning medium is applied and the ink remains are loosened. In the second step, after an intermediate washing cycle, the effects of an alkaline substance set in, in order to strip the alkaline soluble synthetic material which has been transferred during the thermal transfer procedure, from the printing form. After a further washing cycle the remaining printing ink is removed with the acid cleaning medium.

In the case of the above printing form, imaged with a thermal transfer ribbon, the alkaline formulation of the cleaning medium according to the invention proves to be especially advantageous, since both the ink loosening process and also the stripping process for the alkaline soluble synthetic material used for imaging, can be performed in one step. After completing the cleaning the printing form can be rinsed with water.

The combined effect of the acid or alkaline medium and the abrasive particle, among other things results in the surface of the printing form receives a higher level of hydrophilization and can therefore be used immediately for further imaging after the printing form is dry.

The cleaning process is generally carried out by applying the cleaning medium to the printing form or to the cleaning cloth which moves across the printing form. Both mechanical and chemical forces take effect in the cleaning process. The erasing or cleaning cloth used for cleaning is made of a nonwoven fabric, normally a blend of cellulose and polyester fibers.

Since the printing form must be cleaned completely it is also important to make sure that no residual cleaning medium remains on the printing form after the erasing procedure. As little as 0.5% cleaning medium left on the printing form leads to it being unfit for use.

Method of making the cleaning medium

The cleaning medium is prepared as follows. In the case of the acid formulation, the acid is stirred into some of the water. Then, the abrasive agent is added, stirred in portion by portion. The surfactant is then added, again by stirring. The solvent and the remaining part of the water are now added, stirring all the time. The mixture is left in an ultrasonic bath for 30 minutes and then agitated briefly once again. The mixing method can however also be done in a number of other ways, provided that it is guaranteed that there is a stable emulsion/suspension for a longer period of time.

In the case of the alkaline formulation, a surfactant solution is first provided, to which the solvent is then added, stirring all the time. The alkaline substance is then mixed with the resulting mixture and finally the abrasive agent is added portion by portion. In a similar way to that described above, the mixture is then mixed either in an ultrasonic bath or any other known manner whereby a stable emulsion/suspension results. The mixing procedure can also be performed in a number of other ways, provided that it is guaranteed that there is a stable emulsion/suspension for a longer period of time.

The invention will now be described herein with reference to specific examples. Figures given for weights and percentages refer to weight, insofar as not otherwise indicated.

EXAMPLE 1

Formulation For An Acid Cleaning Solution

Fifty (50) g of deionized water is mixed with 6 g/100 g of 85% phosphoric acid and agitated. Then, 4 g/100 g δ-aluminum oxide, $Al_2O_3$—C by Degussa-Hüls, is stirred in portion by portion. After the abrasive agent has been added, 5 g/100 g Triton X-200 as the surfactant is added while stirring constantly. Then, 30 g/100 g Isopar L is stirred in. Finally, the remaining deionized water is added to make up to 100 g. The mixture is set in an ultrasonic bath for 30 minutes and agitated again briefly at the end of this time. The cleaning medium is now ready for use.

EXAMPLE 2

Formulation for an alkaline cleaning solution

Ten (10) g Triton X is added to 100 g water and a homogenous mixture is produced. A 41 g to 100 g formulation of Isopar L® is then added. Next, 45 g of a 0.5 Mol/l NaOH solution, also in relation to 100 g of the formulation, is added. Finally, 4 g/100 g δ-aluminum oxide, $Al_2O_3$—C by Degussa, is stirred into it portion by portion. The mixture is set in an ultrasonic bath for 30 minutes and then agitated again briefly at the end of this time. The result is a ready to use, homogenous milky white emulsion/dispersion, which is stable for at least 24 hours.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A cleaning composition for a printing form imaged by a thermal transfer ribbon, comprising:

a) a substance selected from the group consisting of: a substance capable of producing a pH value of from 1 to 4 in an aqueous solution and a substance capable of producing a pH value of from 10 to 14 in an aqueous solution;

b) a dispersible abrasive agent in a concentration of from 1 to 15 grams per 100 grams of the cleaning composition;

c) a low foam surfactant in a concentration of from 1 to 50 grams per 100 grams of the cleaning composition;

d) an organic solvent in a concentration of from 10 to 50 grams per 100 grams of the cleaning composition; and e) a remainder water, the composition having a viscosity of from 1 to 500 mPas.

2. The composition according to claim 1, further comprising at least one additive.

3. The composition according to claim 1, wherein the substance capable of producing a pH of from 1 to 4 in a aqueous solution with an acid absent present in a concentration from 2 grams to 30 grams per 100 grams of cleaning concentration.

4. The composition according to claim 1, wherein the substance capable of producing a pH of from 10 to 14 in a aqueous solution is a base present in a concentration of from 0.3 grams to 10 grams per 100 grams of cleaning composition.

5. The composition according to claim 4, wherein the acid is selected from the group consisting of oxygen acids from group V elements and oxygen acids from group IV elements.

6. The composition according to claim 5, wherein the acid is phosphoric acid.

7. The composition according to claim 1, wherein the dispersible abrasive agent is selected from the group consisting of metal oxides having a zeta value of at least 0 mV and metal oxides having a zeta value of at least −10 mV at a pH value of 7.

8. The composition according to claim 7, wherein the dispersible abrasive agent is selected from the group consisting of δ—$Al_2O_3$, $ZrO_2$, and $SiO_2$.

9. The composition according to claim 8, wherein the dispersible abrasive agent is δ—$Al_2O_3$.

10. The composition according to claim 1, wherein the surfactant is an anionic surfactant having a polyethylene oxide chain.

11. The composition according to claim 1, further comprising at least one nonionic co-surfactant selected from the group consisting of alkyl polyglycosides, alkyl polyglycolethers and alkyl phenyl polyglycolethers.

12. The composition according to claim 11, wherein the surfactant has anti-static properties.

13. The composition according to claim 1, wherein the solvent is at least one of the group consisting of a paraffinic hydrocarbon, a naphthenic hydrocarbon, and a fatty acid ester.

14. The composition according to claim 13, wherein the solvent includes a branched paraffinic hydrocarbon.

15. The composition according to claim 14, wherein the branched hydrocarbon is an isoparaffin.

16. The composition according to claim 13, wherein the solvent is a mixture of fatty acid esters and at least one of naphthenic and paraffinic hydrocarbons.

17. The composition according to claim 1, further comprising a complexing agent.

18. The composition according to claim 17, wherein the complexing agent is at least one of the group consisting of an organic acid, EDTA, EGTA, AMP, HEDP, and triethanolamine.

19. The composition according to claim 1, wherein the composition has a consistency capable of being metered.

20. The composition according to claim 19, further containing at least one additive.

* * * * *